US006442956B1

(12) United States Patent
Herren

(10) Patent No.: US 6,442,956 B1
(45) Date of Patent: Sep. 3, 2002

(54) DRAIN TUBE AUTO-SERVICING APPARATUS

(76) Inventor: Michael A Herren, 603 W. Elizabeth St., Sulphur, LA (US) 70663

( * ) Notice: Subject to any disclaimer, the term of this patent is extended or adjusted under 35 U.S.C. 154(b) by 0 days.

(21) Appl. No.: 10/026,133

(22) Filed: Dec. 19, 2001

(51) Int. Cl.[7] ..... F25D 21/00

(52) U.S. Cl. ..... 62/150; 62/272

(58) Field of Search ..... 62/150, 155, 272, 62/291, 292, 303; 134/169 C, 195

(56) References Cited

U.S. PATENT DOCUMENTS 6,301,917 B1 * 10/2001 Lacoste ..... 62/286

* cited by examiner

*Primary Examiner*—Denise L. Esquivel
*Assistant Examiner*—Melvin Jones
(74) *Attorney, Agent, or Firm*—Goldstein & Lavas, P.C.

(57) ABSTRACT

An automated apparatus is provided for sealing a low volume drain tube, pressurizing the drain tube, and unsealing the drain tube thereby causing the clearing and blowing out of any contaminants and debris present within the drain tube. The system includes a timer and controller that may be employed for causing a clearing and blowing out of the drain tube at pre-selected and regular intervals.

18 Claims, 4 Drawing Sheets

DRAIN TUBE AUTO-SERVICING APPARATUS

TECHNICAL FIELD

The present invention relates most generally to drain line clearing and servicing apparatus. More particularly, the invention provides an electro-mechanical arrangement for periodically and automatically servicing low volume drain lines that can be come clogged by algae and other contaminants.

BACKGROUND ART

At present air conditioning sub-systems and related equipment are critical components in both commercial and residential environmental control systems. Long term operation of such systems with a minimal need for servicing, is certainly desirable.

In locations where air conditioning (AC) equipment is in constant or near constant use, the need for servicing increases. This is certainly the case in warm locations having extended periods of high temperature and humidity levels. For example, a common problem known to skilled persons is associated with the need to drain off moisture collected during the operation of an AC unit. This moisture, which collects through a condensation process as air is cooled by the AC unit, is typically collected using a drain pan structure, which may also be termed a reservoir. As the condensed fluid builds up, excess amounts are passed to a drain tube or line that is employed to guide this fluid from the drain pan to a remote discharge location. However, this moisture and fluid can, in time, lead to a build up of algae. In locations where the AC unit is heavily used, the drain pan and or drain line will typically develop a significant build up of algae and associated contaminants that can clog the drain line. It may be noted that a clogging up of the drain pan and or drain line can result in costly water damage due to an excessive build up and overflow of condensed fluid. As such, an AC system that is otherwise capable of problem free operation for long intervals of time, may require costly and periodic servicing just to clean or clear items such as drain pans, drain lines, etc.

Therefore, skilled individuals will appreciate a need for efficient, simple, and effective means for periodically and automatically clearing and or breaking up contaminants (e.g., algae) that have built up in the aforementioned structures of an AC unit. A full understanding of the present invention, including an understanding of a number of capabilities, characteristics, and associated novel features, will result from a careful review of the description and figures of several preferable embodiments provided herein. Attention is called to the fact, however, that the drawings and descriptions are illustrative only. Variations and alternate embodiments are contemplated as being part of the invention, limited only by the scope of the appended claims.

SUMMARY OF THE INVENTION

In accordance with the present invention, a drain tube clearing and blow out apparatus is structured for use in blowing out low volume drain tubes and lines that over time tend to become clogged with algae and other possible contaminants and debris. For example, as will be fully discussed below, the present invention is particularly suited to the clearing and cleaning out of drain tube lines of common residential and commercial air conditioning systems.

The apparatus includes a plurality of drain tube sealing devices, with each device located substantially proximate to an end of a drain tube structure. Each sealing device is arranged for selectively being placed in one of a sealed state or an unsealed state. When a sealing device is in a sealed state the respective end at which the sealing device is installed is sealed or closed off. In similar fashion, when a sealing device is placed in an unsealed state the end of the drain tube is unsealed or open. Importantly, each sealing device may be operatively coupled to, and controlled by, a timer and controller for being selectively placed in either a sealed or an unsealed state, as required, for automatically clearing and blowing out of a drain tube or drain tube structure at regular intervals.

The invention further includes an air inlet coupled to the drain tube to enable a source of pressurized air to enter and pressurize the drain tube. Therefore, when each sealing device that is installed at an end of the drain tube is placed in a sealed state, the drain tube may be. pressurized by applying pressurized air to the air inlet. Once the drain tube is pressurized, as determined by the elapsing of a temporal interval, or alternately by sensing a pre-selected pressure level within the tube, one or more sealing devices may be placed in the unsealed state—blowing out and clearing one or more portions of the drain tube.

As skilled persons will appreciate, the inclusion of items such as a timer and controller unit enables the present invention to be configured to automatically and at regular intervals place all sealing devices in a sealed state, apply pressurized air to the air inlet, and selectively or in unison open each sealing device, thereby clearing and blowing out one or more portions of the drain tube. Further, the process may be iterative and repeated a number of times in rapid succession.

With the invention installed in an air conditioning (AC) system, for example, as illustrated in FIGS. 2 through 4, a preferred method of operation may be as follows:

a) The AC system is shut down, with the compressor and blower units thereof preferably not energized;

b) Each sealing device is placed in a sealed state;

c) Pressurized air is applied to the air inlet;

d) After a pre-selected temporal interval has elapsed, or equivalently a desired a pressure level is reached, one or more sealing devices are returned to an unsealed state;

e) If desired or necessary, one or more sealing devices may be repeatedly switched between the sealed state and the unsealed state—while a source of pressurized air is applied to the air inlet—causing additional clearing and blowout events to occur within the same automatic clearing and blowout cycle; and f) The pressurized air source is removed, each sealing device is placed in an unsealed state, and the air conditioning unit turned back on.

The inclusion of a pressure sensing device enables the system operation to be improved, and also adds a self-checking capability to an AC apparatus equipped with the present invention. For example, consider an embodiment of the invention including a pressure sensor structured to sense pressure levels within a drain tube. Should a sealing device fail to operate properly, the pressure sensing device can communicate to the timer and controller that the pressure within the drain tube is inadequate and the drain tube is not being properly pressurized. In contrast, if the pressure sensor in not included and the apparatus of the invention is arranged to simply apply the pressurized air to the air inlet and wait for a temporal interval to expire, the system would not be able to detect such a failure.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

Partial List Of Reference Numerals

10—heating and air conditioning apparatus
10—drain tube clearing and blowout apparatus
10—drain pan or reservoir
10—(condensed or condensational) fluid
10—drain tube or drain line
20*a*—first end of drain tube 20
20*b*—second end of drain tube 20
22—over pressure relief valve
24—trap structure of drain tube
30—blower and heating assembly
32*a*, 32*b*—air flow
34—air inlet
35—source of pressurized air
36—evaporator coil assembly
38—compressor
40—air distribution means
50—sealing device
50*a*—first sealing device
50*b*—second sealing device
54—pressure sensor
60—timer and controller (unit)
60*a*–60*d*—signals (operative couplings)
70—communication module

DETAILED DESCRIPTION AND MODES OF THE INVENTION

Figure 1:
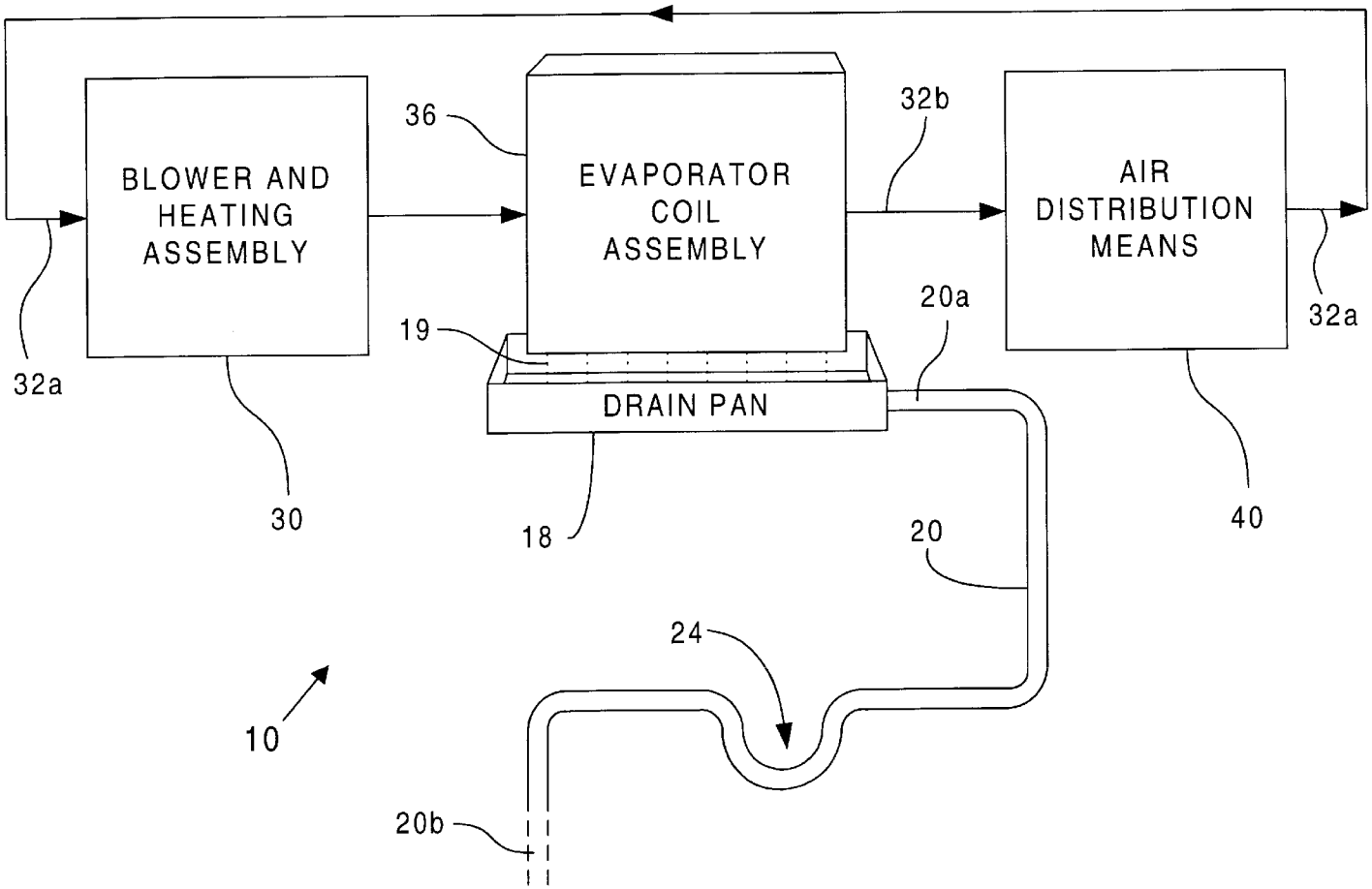
FIG. 1 (PRIOR ART)
FIG. 1 provides a high level conceptual view of a prior art air conditioning apparatus with which the present invention may be utilized.
Figure 2:
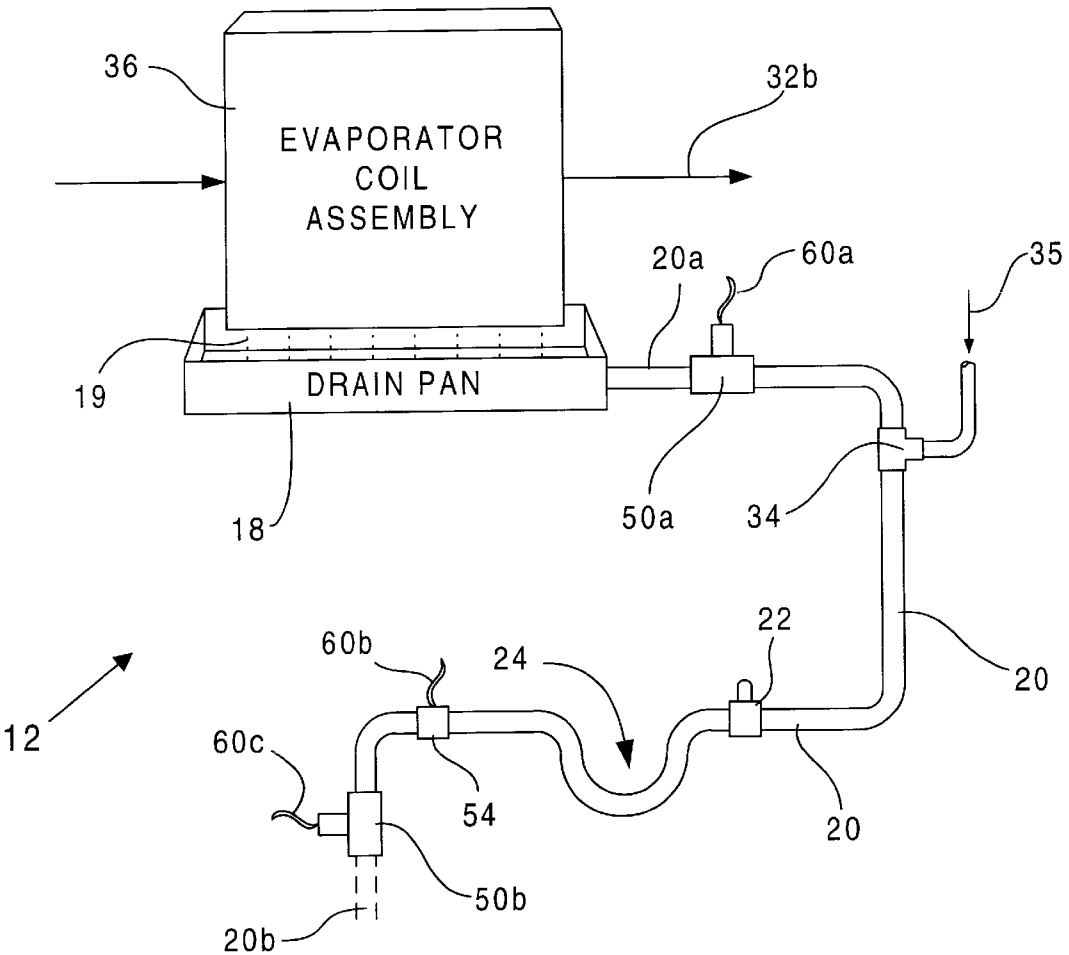
FIG. 2 illustrates components of an embodiment of the present invention installed into the drain line of the heating and air conditioning apparatus of FIG. 1.

Referring now to the drawings, FIG. 1 provides a high level conceptual block diagram of a common heating and air conditioning apparatus 10 with which the present invention may be utilized. The prior art system depicted includes a blower and heating assembly 30 that receives an air flow 32*a* to be heated or cooled. The air flow 32*a* then enters or passes through an evaporator coil assembly 36, and leaves as air flow 32*b*. Air flow 32*b* is then coupled to an air distribution means 40, which delivers the heated or cooled air to a commercial or residential space. Such a space may be said to be climate controlled. Subsequently air flow 32*b* is 'recollected' and coupled back to the blower and heating assembly 30 as air flow 32*a*. As further illustrated in FIG. 1, a drain pan 18 is provided under (or as a portion of) the evaporator coil assembly 36. As fully understood by skilled individuals, when cooling warm and humid volumes of air, moisture condenses and drips from an evaporator coil (not explicitly illustrated) that is provided within the evaporator coil assembly 36. As can be seen in FIGS. 1 and 2, this moisture, which drips as condensational or condensed fluid 19, must be collected and guided to a discharge location. Suitable discharge locations are typically to exterior locations of a building, or alternately a drain line of a building's plumbing system.

Accordingly, a drain tube 20 is coupled to the drain pan 18 to receive a flow of condensed fluid 19 for discharging purposes. As clearly shown in FIGS. 1 and 2, a typical drain tube 20 will have a first end 20*a* arranged to receive the condensed fluid 19 and a second end 20*b* from which the fluid is discharged. The drain tube 20 is often provided as a ⅝ to ¾ inch tube, and may include a trap structure 24. The trap structure 24 is included to prevent insects and other items from entering the drain tube and or evaporator coil assembly 36.

Figure 3:
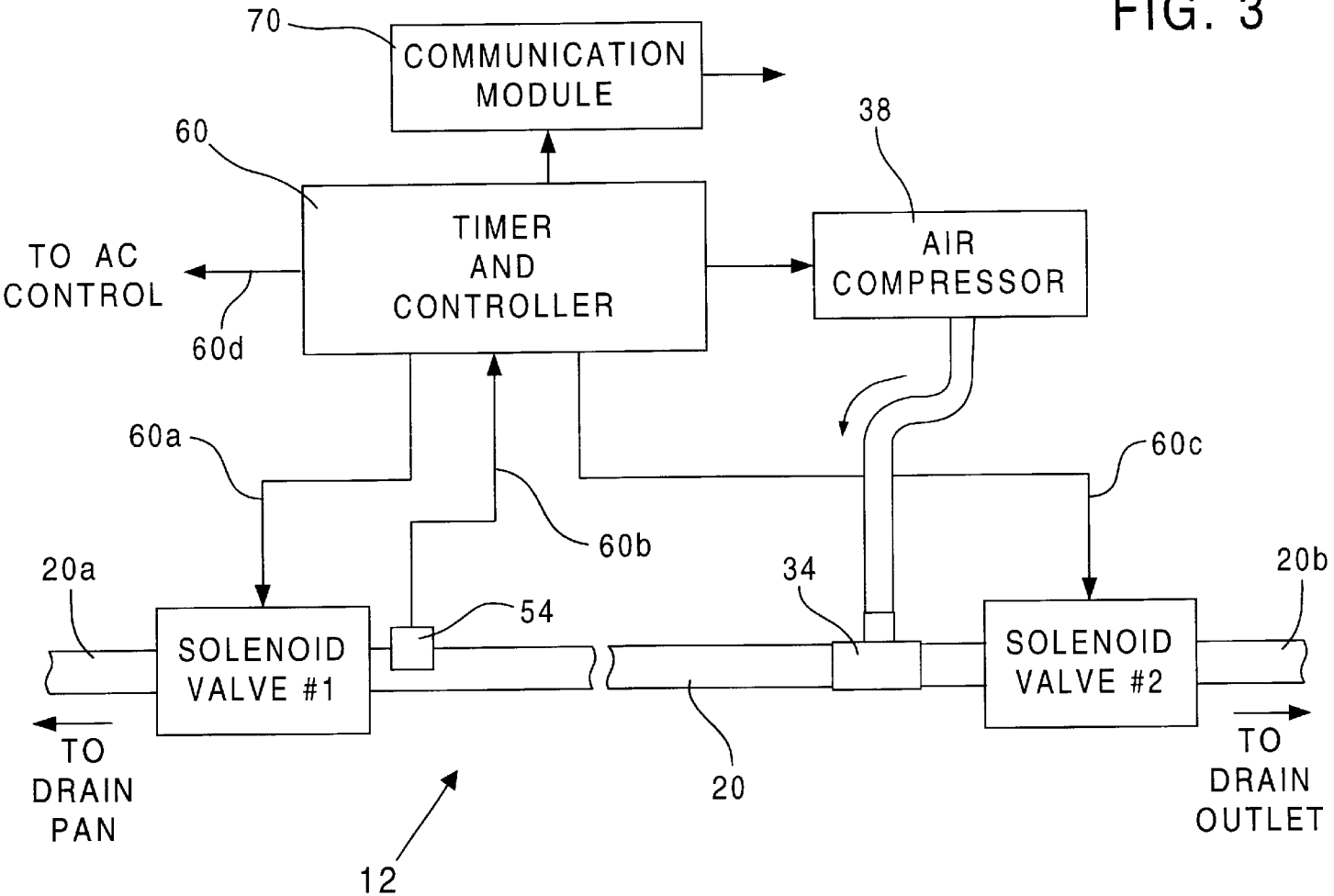
FIG. 3 is a high level block diagram of a preferred embodiment of the present invention.
Figure 4:
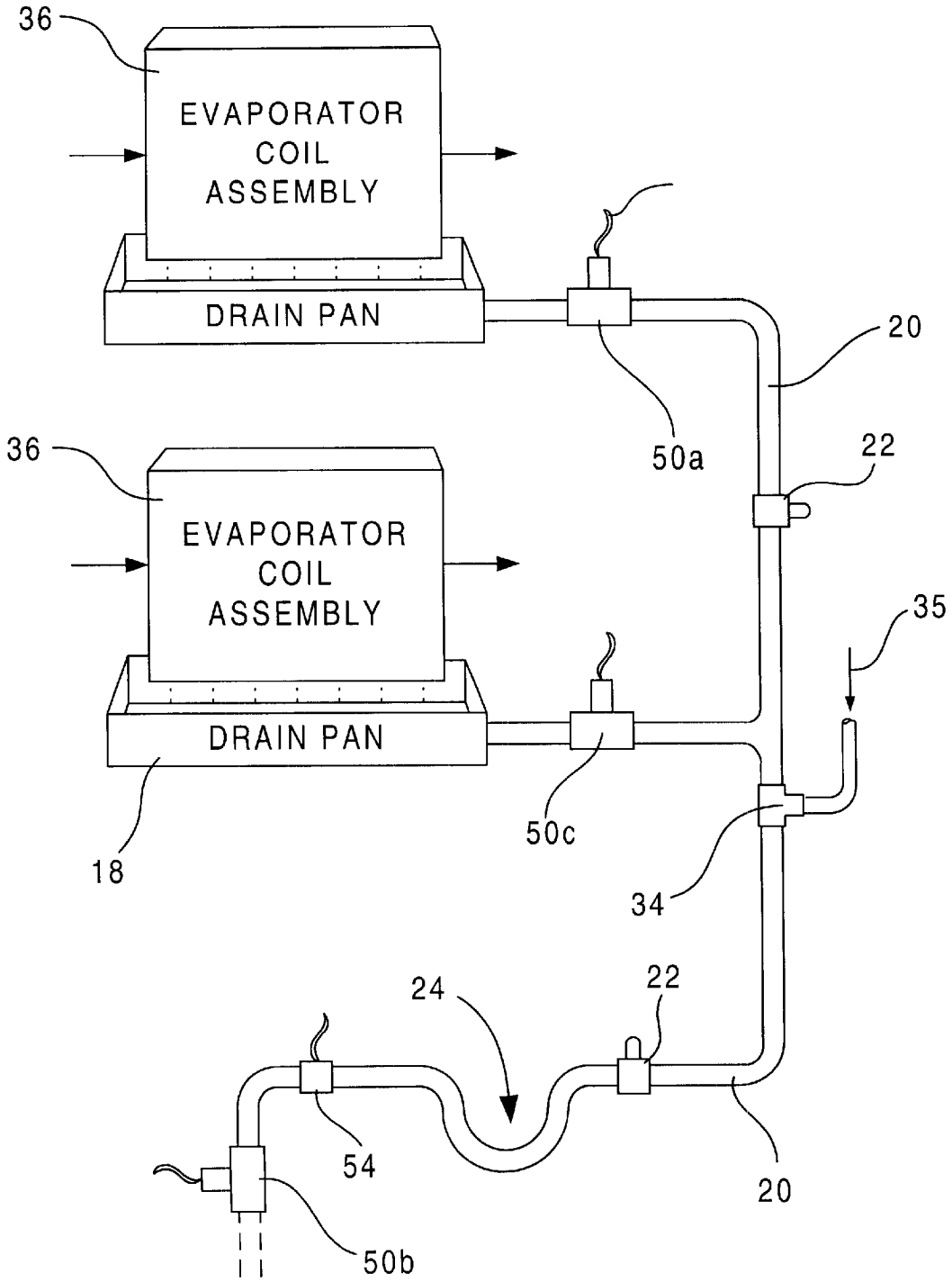
FIG. 4 illustrates installed components of another embodiment of the invention.

Turning to FIG. 2, portions of the present invention are depicted installed upon an embodiment of the heating and air conditioning apparatus as provided in FIG. 1. As shown, a first drain tube sealing device 50*a* is located substantially proximate to the first end 20*a* of the drain tube 20. The sealing device 50*a* is structured for selectively being placed in one of a sealed state or an unsealed state. When in a sealed state an associated drain tube end 20*a* of a drain tube 20 at which the sealing device is installed is sealed or closed off—and no water or air can pass through end 20*a*. In similar fashion, when the sealing device 50*a* is placed in an unsealed state, the end 20*a* of the drain tube 20 is unsealed or open. Importantly, each sealing device is preferably individually operatively coupled to, and controllable by, a timer and controller 60 (as shown in FIGS. 3 and 4). Accordingly, each sealing device can be selectively placed in either a sealed or an unsealed state, as required, for clearing and blowing out a drain tube 20 at regular intervals. Importantly, it must be understood that a first sealing device may actually be located at either an entry end or an exit/discharge end of a drain tube. As such, the term 'first' when applied to an end of a drain tube, or a respective sealing device, is best understood in the context in which the term is employed. It may also be noted that additional sealing devices, such as a second drain tube sealing device 50*b*, and third sealing device 50*c* (of FIG. 4) are each located at or proximate to other ends of the drain tube 20. When each sealing device is placed in a sealed state, an air inlet 34 may be employed to couple a source of pressurized air 35 to the sealed drain tube 20 to pressurize the drain tube. The pressurized air may be applied to the drain tube 20 for a fixed temporal duration before additional clearing and blowout actions and activities commence. Alternately, the pressurized air may be applied with a pressure level sensed, in real-time, to determine when and if the pressure level within the drain tube 20 attains a pre-selected and desired level. As such, the use of a pressure sensor enables the timer and controller 60 to determine if the source of pressurized air 35 is adequate for suitably clearing and blowing out the drain tube 20. If the pressure level applied to the air inlet 34 does not sufficiently pressurize the drain tube, the inclusion of a pressure sensing device, such as pressure sensor 54, enables the sensing of such a low pressure situation and the preferable placing of a service call to an appropriate service technician.

As shown in FIGS. 2 and 3, most preferred embodiments of the present invention may further include an over pressure relief valve 22, which is provided as a safety device. Should a component of the treatment apparatus fail to operate properly and result in an over pressure situation within the drain tube 20, the over pressure relief valve 22 would enable the pressure to be reduced or maintained at a safe level. The term 'over pressure situation' may be assumed to indicate that the pressure level applied to and or present within the drain tube is approaching an unsafe level. In such a situation the drain tube or a coupling thereof may nearing a point of mechanical failure. As skilled persons will understand, the over pressure relief valve 22 may be placed in one of a number of available positions within the drain tube 20, within the portion sealed off when the sealing devices are each placed in a sealed state.

It may be noted that the arrangement of FIG. 4, wherein a plurality of drain tube ends are provided, may be best termed a 'drain tube structure'. This structure may be formed by coupling a number of segments of tubing, and may have 2, 3, or more ends. Accordingly, the expression drain tube structure is intended to be broadly fined and apply to the arrangements of FIGS. 1 through 3, as well as FIG. 4.

Turning now to FIG. 3, there is shown a simplified high level block diagram of a preferred embodiment 12 of the present invention. As shown, at least two drain sealing devices are preferably provided as solenoid valve #1 and solenoid valve #2. Solenoid valve #1 is operatively coupled to the timer and controller 60 by a control signal 60*a*, while solenoid valve #2 is operatively coupled to the timer and controller 60 by a second control signal 60*c*. Further, as illustrated in FIG. 4, should other ends of drain tube 20 exist, additional solenoid valves would preferably be included and also suitably operatively coupled to the timer and controller 60. As illustrated in FIG. 3, each solenoid valve is situated proximate to an end of the drain tube 20, for sealing and unsealing the associated end of the drain tube.

Also included in FIG. 3 is a compressor 38 that may be provided for producing pressurized air. As shown, the compressor 38 is also operatively coupled to the timer and controller 60 and may be selectively switched on to commence producing pressurized air when needed. When the compressor 38 is switched on by the timer and controller 60, pressurized air is coupled to the air inlet 34 and the drain tube 20 may be pressurized. The compressor 38 would be switched off when the unit is in a standby mode and not being employed for clearing and blowing out the drain tube 20. A preferred method of operation supported by the invention will be disclosed by way of a series of activities that may be visualized using FIG. 3. Upon power-up, the timer and controller 60 may be arranged to place each sealing device in a sealed state and apply a source of pressurized air 35 at the air inlet 34. The drain tube 20 pressurizes. If a pressure sensor 54 is included, the system may be configured to verify that a desired and pre-selected pressure level is attained within a specified temporal interval. As illustrated, the timer and controller 60 may receive the pressure level via signal 60*b*. If the pressure level is not attained with the specified interval, a communication module 70 may be activated to place a service call to a pre-selected service entity. Typically a service entity would be a service and repair organization and or a service technician.

In addition, on power-up the apparatus 12 of the invention may run one of a number of 'clearing and blowout' cycles. For example, activities associated with a preferred clearing and blowout cycle may be outlined as follows:

The AC system is shut down. This may involve disabling or powering down compressor units and or blower units of the AC system. As shown in FIG. 3, yet another control signal 60*d* may be employed to shut down the heating and air conditioning system 10;

Each sealing device is placed in a sealed state, thereby sealing each end of the drain tube 20;

A source of pressurized air 35 is applied to the air inlet 34. If each sealing device is functioning properly, the drain tube will rapidly pressurize;

After a pre-selected temporal interval has elapsed, or equivalently if a pressure sensor 54 is include, a desired a pressure level is reached, one or more sealing devices are selectively returned to an unsealed state;

If desired or necessary, one or more sealing devices may be alternately switched between the sealed state and the unsealed state, while a source of pressurized air is continually applied to the air inlet, causing additional clearing and blowout events to occur.

In a most preferred method of operation it may be desirable to sequence through each sealing device wherein each sealing device is switched from a sealed state to an unsealed state and then back to a sealed state. This sequence may be applied to each sealing device one after the next, possibly a number of times each. Once all clearing and blowout activities have been completed, the source of pressurized air 35 is disabled and or removed, and all the sealing devices may all be placed in an unsealed state. The heating and air conditioning system may then be restarted via control signal 60*d*.

It must be understood that the above method is only one of many possible methods that may be practiced with the apparatus 12 of the invention. For example, it may be desirable to apply the source of pressurized air continually and simply seal and unseal all sealing devices in unison. As such, a single control signal 60' (not illustrated) may be employed to simultaneously control all sealing devices. Alternately, it may be preferable to unseal a sealing device that is nearest the discharge end 20*b* of drain tube 20 before opening other sealing devices. Therefore, while there have been described a plurality of the currently preferred embodiments of the present invention, other variations are certainly possible. For example, a constantly available source of pressurized air may simply be coupled to the air inlet by activating yet another solenoid-type valve (not illustrated). Accordingly, those skilled in the art will recognize that other and further modifications may be made without departing from the invention and it is intended to claim all modifications and variations as fall within the scope of the invention and the appended claims.

What is claimed is:

1. An apparatus structured for auto-servicing a low volume drain tube, the drain tube structured with a first end where condensed fluid, which is to be discharged, enters the tube, and a second end where condensed fluid exits the drain tube at a remote discharge location, the apparatus comprising:

a) a timer and controller;

b) a first drain tube sealing device located substantially proximate to the first end of the drain tube, the sealing device responsive to the timer and controller for selectively being placed in a sealed state or an unsealed state, wherein the first end of the drain tube is sealed when the sealing device is in the sealed state and unsealed when the sealing device is in the unsealed state;

c) a second drain tube sealing device located substantially proximate to the second end of the drain tube, the second sealing device also responsive to the timer and controller for selectively being placed in a sealed state or an unsealed state, wherein the second end of the drain tube is sealed when the second drain tube sealing device is in the sealed state and unsealed when the second drain tube sealing device is in the unsealed state; and d) a pressurized air inlet operatively coupled to the drain tube for enabling pressurized air to be coupled to, enter, and pressurize the drain tube when the first and second drain tube sealing devices are each placed in the sealed state;

e) the timer and controller arranged for periodically placing each sealing device in the sealed state, and causing a source of pressurized air to be applied to provide pressurized air to the air inlet, thereby pressurizing the drain tube for a temporal interval, and subsequently causing each sealing device to be returned to the unsealed state, wherein the process of returning each sealing device to an unsealed state causes a blowing out of any contaminants that are present inside the drain tube and at or near the first end or the second end thereof.

2. The apparatus in accordance with claim 1, wherein after each sealing device is placed in the sealed state and the temporal interval expires, the timer and controller places one of the first or second sealing devices in the unsealed state before placing remaining sealing devices in the unsealed state.

3. The apparatus in accordance with claim 2, wherein the pressurized air is applied to the air inlet and sealing devices are employed to seal, pressurize, and unseal the drain tube repeatedly for a pre-selected number of iterations.

4. The apparatus in accordance with claim 1, further including a pressure sensor operatively coupled to the timer and controller to indicate when, after each sealing device is placed in the sealed state and pressurized air is applied to the air inlet, a pressure level within the drain tube has reached a pre-selected pressure level.

5. The apparatus in accordance with claim 4, wherein the temporal interval is variable and equal to a period beginning when each sealing device is placed in the sealed state and ending when the pressure within the drain tube has reached the pre-selected pressure level, as determined by the pressure sensor.

6. The apparatus in accordance with claim 5, wherein the pre-selected pressure level is selectable by a service technician.

7. The apparatus in accordance with claim 5, wherein the timer and controller is configured to seal, pressurize, and cause a blowing out of the drain tube at pre-determined regular intervals.

8. An apparatus in accordance with claim 1, wherein the apparatus includes an air compressor that is controlled by the timer and controller and coupled to the air inlet to provide pressurized air thereto.

9. A drain tube clearing apparatus, comprising:

a) a timer and controller;

b) a plurality of drain tube sealing devices, each located substantially proximate to an end of a drain tube structure of an air conditioning system, wherein each sealing device is responsive to the timer and controller for selectively being placed in one of a sealed state or an unsealed state, wherein an end of the drain tube associated with a respective sealing device is sealed when the sealing device is in the sealed state and unsealed when the sealing device is in the unsealed state;

c) a pressurized air inlet operatively coupled to the drain tube for enabling pressurized air to pressurize the drain tube when each of the sealing devices is placed in the sealed state;

d) a pressure sensor operatively coupled to the timer and controller to communicate to the timer and controller a pressure level within the drain tube;

e) the timer and controller arranged to periodically place each sealing device in the sealed state, and cause a source of pressurized air to be applied to the air inlet causing the drain tube to be pressurized to a pre-selected pressure level, as sensed and communicated by the pressure sensor, with the timer and controller configured for subsequently returning each sealing device to an unsealed state, thereby a blowing out of any contaminants that are present inside or proximate to an end of the drain tube.

10. The apparatus in accordance with claim 9, wherein the air conditioning unit is shut down, each sealing device is placed in the sealed state, the drain tube is pressurized, with a sequence of subsequent actions including:

a) placing a first selected sealing device in the unsealed state, thereby clearing an end of the drain tube associated with the first sealing device;

b) placing the first selected sealing device back in a sealed state;

c) repeating steps a) and b) for each additional selected sealing device, in succession, until each selected sealing device has been changed from a sealed state back to an unsealed state, at least one time;

d) placing all sealing devices in the unsealed state; and e) restarting the air conditioning unit.

11. The apparatus in accordance with claim 10, wherein the pressurized air is continually applied to the air inlet until each sealing device has been placed in the unsealed state at least once.

12. The apparatus in accordance with claim 9, wherein the pressurized air is applied to the air inlet and sealing devices are employed to seal, pressurize, and unseal the drain tube repeatedly for a pre-selected number of iterations.

13. The apparatus in accordance with claim 9 wherein a communication module is included such that if a pre-selected temporal interval expires before a pressure level within the drain tube reaches a pre-selected pressure level, the communication module is activated placing a service call to a pre-determined service entity.

14. The apparatus in accordance with claim 13, wherein the pre-selected pressure level is selectable by a service technician.

15. An apparatus in accordance with claim 13, wherein the timer and controller is configured to seal, pressurize and blowout the drain tube at regular intervals.

16. An apparatus in accordance with claim 9, wherein the apparatus includes an air compressor that is controlled by the timer and controller and coupled to the air inlet to provide pressurized air thereto.

17. A method for auto-servicing and blowing out a low volume drain tube structure, the drain tube structure having at least one end where fluid enters, and at least one other end where fluid exits the structure at a remote discharge location, the method comprising the steps of:

a) placing each of a plurality of sealing devices located at each respective end of the drain tube structure in a sealed state, thereby sealing all ends of the drain tube structure;

b) applying pressurized air to pressurize the drain tube structure;

c) waiting for one of:

i) a pre-selected temporal interval to expire; or ii) a pre-selected pressure level to be reached;

d) placing at least one sealing device in an unsealed state, thereby causing a clearing and blowing out of at least one portion of the drain tube structure;

e) placing all sealing devices in an unsealed state; and f) removing or disabling a source providing the pressurized air to pressurize the drain tube structure.

18. The method in accordance with claim 17, further including the additional steps of:

a) shutting down an air conditioning unit to which the drain tube structure is attached before any sealing devices are placed in a sealed state; and b) restarting the air conditioning unit after all sealing devices are placed in an unsealed state after blowout activities have been completed.

* * * * *